United States Patent [19]

Weingartner et al.

[11] Patent Number: 4,788,835

[45] Date of Patent: Dec. 6, 1988

[54] FLATBED KNITTING MACHINE WITH ELECTRONIC CONTROL

[75] Inventors: Albin Weingartner; David Retallick, both of Munich, Fed. Rep. of Germany

[73] Assignees: Universal Maschinenfabrik, Westhausen, Fed. Rep. of Germany; Dr. Rudolf Schieber GmbH & Co., KG, Westhausen, Fed. Rep. of Germany

[21] Appl. No.: 231,560

[22] Filed: Feb. 4, 1981

Related U.S. Application Data

[63] Continuation-in-part of Ser. No. 190,771, Sep. 25, 1980.

[30] Foreign Application Priority Data

Oct. 1, 1979 [DE] Fed. Rep. of Germany ..... 2939819

[51] Int. Cl.[4] ..... D04B 7/00

[52] U.S. Cl. ..... 66/75.2

[58] Field of Search ..... 66/75.2, 232, 231, 238; 364/470

[56] References Cited

U.S. PATENT DOCUMENTS

| | | | |
|---|---|---|---|
| 3,817,059 | 6/1974 | Krause | 66/75.2 |
| 3,825,900 | 7/1974 | Anderson | 66/75.2 |
| 3,844,139 | 10/1974 | DeCerjat et al. | 364/470 X |
| 4,018,064 | 4/1977 | Doslik | 66/232 |
| 4,192,157 | 3/1980 | Hida et al. | 66/75.2 |
| 4,269,045 | 5/1981 | Hida et al. | 66/75.2 |

FOREIGN PATENT DOCUMENTS

| | | | |
|---|---|---|---|
| 1398924 | 6/1972 | United Kingdom | 364/470 |

*Primary Examiner*—Ronald Feldbaum
*Attorney, Agent, or Firm*—Sughrue, Mion, Zinn, Macpeak, and Seas

[57] ABSTRACT

In a flatbed knitting machine with electronic control and comprising programmable fixed-word stores and freely accessible stores, all the data for the operation of the machine is split into five divisions, namely motif pattern draft, needle set-up, knitting plan, function number schedule, and plan run. Data sub-groups from the needle set-up division, together with associated special function numbers for call-up, are stored in the fixed-word stores. Motif designs are created using the data stored in the divisions for needle set-up and plan run and by means of external selector switches on the machine. Facilities are provided for mirror-imaging and for suppression of part or all of a motif.

10 Claims, 5 Drawing Sheets

MC1488, 1489A
PIN 1: -12V
7: LOG GND
74LS04, 10
PIN 7: LOG GND
14: +5V
8T26
PIN 8: LOG GND
16: +5V
20 PIN DOUBLE-HEADER $8900 'BAND'
C1 ACIA 6850 $6900
DCD
CTS
RTS
RX
TX
MC1489AL
MC1488L
26 PIN DOUBLE-HEADER $8A00 'BF'
B1 PIA 6820 $8A00
MC 14411
B5
1.8432 MHz
DTDS-12D100
DC/DC
RS-232-C
LOG GND

+5V
LOG. GND.
8-BIT DATA BUS
16-BIT ADDRESS BUS
CE
RESET
8T97
A3
A2
B3
74LS42
A1
8T26
A4
A5
MC 6802
C1
XTAL
EXTAL
4 MHz
22pf
RES.
10K
100K
1K
1MF
TCA 345A
VMA
74LS04
RE
E
MR
+5V
R/W
BA
V STANDBY
VCC
HALT
NMI
IRQ
VSS
74LS10

DATA
ADDRESSES
PROM7 E6
PROM6 D6
PROM5 E4
PROM4 D4
PROM3 E3
PROM2 D3
PROM1 E1
PROM0 D1
EPROM 2716
74LS42 C5
74LS10 C6
B5
B6
10K
+5V
PROM DISABLE

| | |
|---|---|
| | FIG. 5C |
| FIG. 5A | FIG. 5B |

FLATBED KNITTING MACHINE WITH ELECTRONIC CONTROL

FIELD OF THE INVENTION

This invention relates to a flatbed knitting machine with electronic control, which comprises programmable fixed-word stores in the form of PROMs and freely accessible stores in the form of RAMs, as well as structural means for entering the data for the operation of the machine.

DESCRIPTION OF THE PRIOR ART

One such flatbed knitting machine with electronic control is already known from published West German patent application No. 2301847. The entry of data is accomplished in that machine either by means of a magnetic tape store or manually.

In flatbed knitting machines with electronic control the preparation and entry of data for the operation of the flatbed knitting machine has until now been complex and time-consuming, so that this entry of data can only be carried out successfully by specially trained specialists. Any step which simplifies the entry of the data e.g. as disclosed in U.S. Pat. No. 4,311,029 issued Jan. 19, 1982, thus leads to an increased practical value of the flatbed knitting machine.

SUMMARY OF THE INVENTION

It is an object of the present invention to provide a flatbed knitting machine of the type first referred to above which requires the smallest possible expenditure in the preparation of the flatbed knitting machine for use by the operator and which also makes it possible very simply to carry out pattern variations. The machine should also be such that there is the smallest possible likelihood of faults occurring in the data entry procedure.

This is achieved in accordance with the present invention in that the electronic control system is constructed and connected in such a way that the data is arranged to be stored in the electronic control system split into five divisions, namely motif pattern draft, needle set-up, knitting plan, function number schedule and plan run; data sub-groups from the division for needle set-up, together with associated special function numbers for call-up, are stored in the fixed-word stores of the electronic control system; and motif designs are dealt with without interference with the knitting program by means of the data stored in the divisions for needle setup and plan run and by means of external selector switches on the machine.

With this flatbed knitting machine there is a considerable reduction in the time expended by the operator in carrying out the data entry procedure as well as a considerable reduction in the complexity of the data entry procedure, and at the same time the operator has the possibility of forming motifs in the knitting pattern in a time-saving manner and of varying these in many ways.

The divisions for motifs pattern draft, needle set-up, in part function number schedule and plan run contain data specific to the pattern, while the division for knitting plan and associated data groups from the division for function number schedule contain data specific to the machine, i.e. data stored permanently in the fixed-word stores of the electronic control system.

Preferably, the electronic control system is constructed and connected in such a way that data sub-groups from the division for needle set-up are stored in the fixed-word stores of the electronic control system together with associated special function numbers for frequently used knitting techniques, such as RR welts, 2:1 welts, and 1:1 welts. Furthermore, data sub-groups of this type for the running of standard knitting, such as separating courses with 2:1 welts and transfer courses, can also be stored in the fixed-word stores of the electronic control system.

The data sub-groups from the division for needle set-up, together with associated function numbers for the aforementioned special functions, can advantageously be stored, and possibly also recalled later, by means of respective individual function keys In order to be able to carry out motif design in the form of horizontal mirror-imaging in a rapid and simple way, the electronic control system is preferably constructed and connected in such a way that, upon the storage of the data from the division for needle set-up, needle set-ups in the reverse sequence are also stored and can be called up for operation in the reverse sensed A simple and rapid vertical mirror-imaging facility for motifs can be achieved if, upon the storage of the data from the division for plan run, data is stored for the steps in reverse, and can be called up later as appropriate. Horizontal and vertical mirror-imaging of motifs an be combined to make possible the creation of a double mirror image and of one needle/course mirror-imaging In accordance with a preferred embodiment of flatbed knitting machine of the invention, the electronic control system is constructed and connected in such a way that, upon the storage of the data from the divisions for needle set-up and plan run, certain needles and/or courses of knitting can be omitted. By this means one creates the possibility of partial mirror-imaging, and, with the omission of only one needle or one course of knitting, one creates the possibility of a direct mirror-imaging about the centre wale or centre course. The motif can also be mirror-imaged with any desired offset in the horizontal and vertical directions.

A further possibility for designing motifs arises if the external selector switches on the machine are provided for the entry of commands for motif suppression and if the electronic control system is constructed and connected in such a way that motifs can be designed without interfering with the knitting program by allocating motif segments to the respective external selector switches and by selective suppression of these motif segments. The external selector switches are identified in the knitting program, but their values are set directly on the machine. If a motif is allocated to a selector switch and if this switch is set to zero, then this motif does not appear, i.e. the motif is not knitted. The selector switches can influence both horizontal and also vertical program runs, and the commands of the selector switches are effective over all five program segments.

If several selector switches set one behind another are set to zero, then for example a knitted garment provided with several motifs according to the overall program can be knitted in "plain".

For further simplification of the data entry, the electronic control system of the flatbed knitting machine of the present invention is preferably constructed and connected in such a way that all data for the operation of the flatbed knitting machine can be extracted from the stores of the electronic control system and transferred to external data carrier mans, for example to magnetic tape cassettes. The extraction of the data for external data carriers makes it possible to effect archival storage of the data as well as very rapid repeat entry into the machine if a program which has been put together at an earlier date is later to be knitted.

BRIEF DESCRIPTION OF THE DRAWINGS

The invention will be further described with reference to the following drawings, in which.

DESCRIPTION OF THE INVENTION

Figure 1:
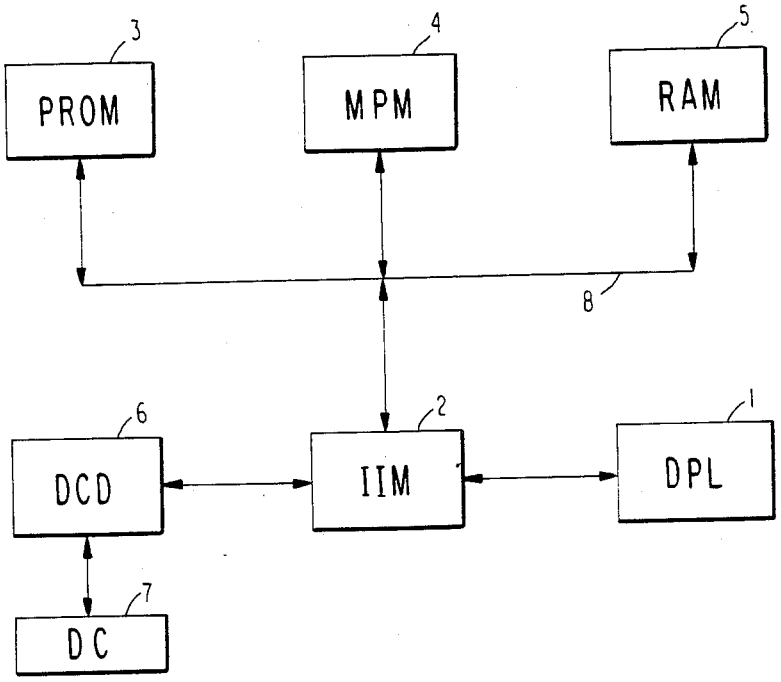
FIG. 1 is a block diagram of an electronic control system in the flatbed knitting machine according to the present invention.

For the entry of data for the operation of a flatbed knitting machine with electronic control, a complete knitting program is preferably provided on a magnetic tape. This magnetic tape is then read into the electronic control system of the machine by means of a tape playing machine. The electronic control system of the flatbed knitting machine comprises fixed-word stores, for example in the form of PROMs, and freely accessible stores, for example in the form of RAMs. With a control system of this type, the data for the operation of the machine can be complemented by reading in one or more divisions of data and thereby creating a new overall program. The putting together of the data is effected by means of special pre-prepared data cards or sheets, with a separate data card or sheet being associated with each division.

The total data for the operation of the flatbed knitting machine is split into a total of five divisions in order to accomplish extremely simple and fault-free entry of data with the smallest possible expense on the part of the operator entering the data. The five divisions of data are a first division for motif pattern draft T, a second division for needle set-up N, a third division for knitting plan Z, a fourth division for function number schedule F and a fifth division for plan run S.

The first division of data for motif pattern draft T corresponds to a technical pattern draft for the knitting, stitch transfer and stitch acceptance for the needle beds in, for example, the setting up of a cable pattern.

The second division of data for needle set-up N includes the horizontal extent of the knitting process. A normal entry is possible with automatic repeat over the whole machine width. More than eight knitted strips or needle spacing widths must be established over the individual entry. A total of up to 64 needle set-ups is possible. Furthermore, up to 64 selector switches are provided on the machine with a maximum value of 255 repetitions of data and data groups.

The data both for the division for motif pattern draft T and also for the division for needle set-up N are pattern-specific data.

The third division for knitting plan Z refers to the establishment of rows for standard patterns, i.e. the data about what should happen in a row, for example inversion, shifting, starting, finishing off, thread guide selection. This division for knitting plan Z includes machine-specific data for the knitting of standard patterns, coloured and inverted Jacquard patterns, such as two-colour Jacquard patterns, three-colour Jacquard patterns, four-colour Jacquard patterns, half-tubular inverted patterns and cable patterns. The data of this division for knitting plan Z is entered into the fixed word stores of the electronic control system of the flatbed knitting machine and can be called up from there by a function key or can be transferred to external data carriers for archive storage.

The fourth division of data is the division for function number schedule F. This division includes the data about the insertion of the function rows laid down in the division for knitting plan Z, such as about the insertion of function rows from the pattern-specific data. Each recurring function row can be called up at random from the machine-specific division for knitting plan Z. The data of the division for function number schedule F which is wholly relevant to the division for knitting plan Z is likewise-transferred into the fixed-word stores of the machine. The remaining pattern-specific data from the division for function number schedule F is entered into the electronic control system of the machine each time that the machine is prepared for use. The division for function number schedule F refers among other things to the pattern repeat of the knitted piece.

The fifth division of data is the division for plan run S. This division includes pattern-specific data for the vertical extent of the knitting. The data is entered into the electronic control system by the operator each time that the machine is prepared for the knitting operation.

As already mentioned, the data for the standard pattern of coloured and inverted Jaccuard pattern, for example half-tubular inverted patterns, cable patterns or 2,3 and 4-colour Jaccuard patterns, can be composed as permanently recurring data and can be established in the division for the data relating to knitting plan Z. The data of the division for knitting plan Z is then stored permanently in the control system of the flatbed knitting machine together with the data of the division for function number schedule F which is additionally necessary for the standard pattern, and the data remains there for call up or for transfer from the store for archive storage purposes.

The data of the remaining divisions is established anew each time and is entered into the machine. Thus, for the whole extent of the knitting, all the data of the five divisions are used jointly. It is true that different motif pattern drafts T show different motif patterns, but from the point of view of knitting technique they have the same run.

In order to make the preparation of the data for the operation of the flatbed knitting machine, and also to make the storage of the data in the machine, as simple as possible, special functions are inserted for frequently-used knitting techniques, such as RR-welt, 2:1 welt, 1:1-welt, etc. as well as for standard knitting, for example separating rows with 2:1-welt and transfer rows. These special functions make it possible to work these combinations without allocating part rows to them. For this, data sub-groups from the division for needle set-up N are combined with associated special function numbers, and are stored for call-up in fixed-word stores of the electronic control system. The control system then determines the correct choice of needle automatically. A pattern specification for these combinations is consequently not necessary. The special functions are called up for each knitting cam by means of the special function numbers.

A further possibility for the simplification of the data preparation and data entry for the design of motifs consist in the alteration of data from the divisions for needle set-up N and plan run S for mirror-imaging of the motif. For this purpose, when the data is stored from the division for needle set-up N, needle set-ups in the reverse sense are also stored and can be recalled later as appropriate, with the result that horizontal mirror-imaging, i.e. needle mirror-imaging can be carried out in a simple way. By storing the data from the division for the plan run S and recalling it later as appropriate one can also preplan a vertical mirror-imaging in a simple way, i.e. mirror-imaging of the rows. The two types of mirror-imaging can be combined to produce a double mirror-imaging horizontally and vertically, i.e. a needle/row mirror-imaging.

If in the storage of the data from the divisions for needle set-up N and plan run S, needles and/or rows of knitting are omitted, then a total or direct mirror-imaging results, and partial mirror-imaging is also possible. The omission of one needle or one row makes it possible to effect mirror-imaging about the centre wale or about the central row. It will be appreciated that the motif can also be mirror-imaged with any amount of offset in the horizontal and vertical directions.

For the creation of further motifs, individual motifs can be set on external selector switches on the machine The external selector switches are referred to in the knitting program, but their values are nevertheless set directly on the machine If a selector switch is set to zero, then the corresponding motif is not knitted, with the result that motifs can be designed without interfering with the knitting program. This applies both to horizontal and also to vertical program runs.

If selector switches controlled one following another are set to zero, then a piece of knitting provided according to the knitting program with several motifs can be knitted in "plain". The instructions of the external selector switches are allocated in the knitting program to all five divisions of data.

With the sub-division of the data necessary for the operation of the flatbed knitting machine into five divisions, with the storage of special functions in the form of data sub-groups from the division for needle set-up N and motif-related insertions in the division for needle set-up N and plan run S, as well as with the giving of instructions by way of the external selector switches, it is possible not only to achieve simplified data input into the machine, but it is also possible to archive the data for complete knitting programs quickly and cheaply. This archiving can be in the form of recall and transfer storage of the complete data to external data carriers, preferably magnetic tapes. Thus, either only the data of the five divisions, or alternatively additionally the data given by the setting of the external selector switches, can be called out from the machine and archived. The external data carriers containing all the data for a particular knitting process of one or more pieces of knitting can then be used again for entry of the data into the machine by trainee auxiliary personnel. By this means it is possible, using the data archived on the external data carriers, to establish displays of data which give the operator a direct oversight of the stored data in a form specific to the knitting machine.

The construction and connection of the electronic control system of the flatbed knitting machine will be additionally explained based on the block diagram shown in FIG. 1.

In the block diagram according to FIG. 1, block 1 is an element mounted in the frame of the flatbed knitting machine which contains a key board, a display, counter means and switch means.

Block 2 is an internal interface module IIM, block 3 is a programmable read only memory PROM, block 4 is a microprocessor module MPM, and block 5 is a random access data memory RAM, the blocks 2 to 5 being constructed as IC modules and having the detailed circuit configurations shown in FIGS. 2 through 5, respectively.

Block 1 and block 2 are interconnected in a well known manner for bidirectional communications. The IC modules or blocks 2, 3, an 5 operate on a common address, data and control bus 8 and receive information and signals respectively from this bus 8. The part numbers shown in FIGS. 2–5 are common to various manufactures from which the parts are available, and with the detailed hardware connections illustrated in FIGS. 2–5, the construction of the present invention will be easily apparent.

For the operating function and construction respectively of the electronic control system according to claims 1 to 10 the blocks 1 to 5 are provided and used.

Figure 2A:
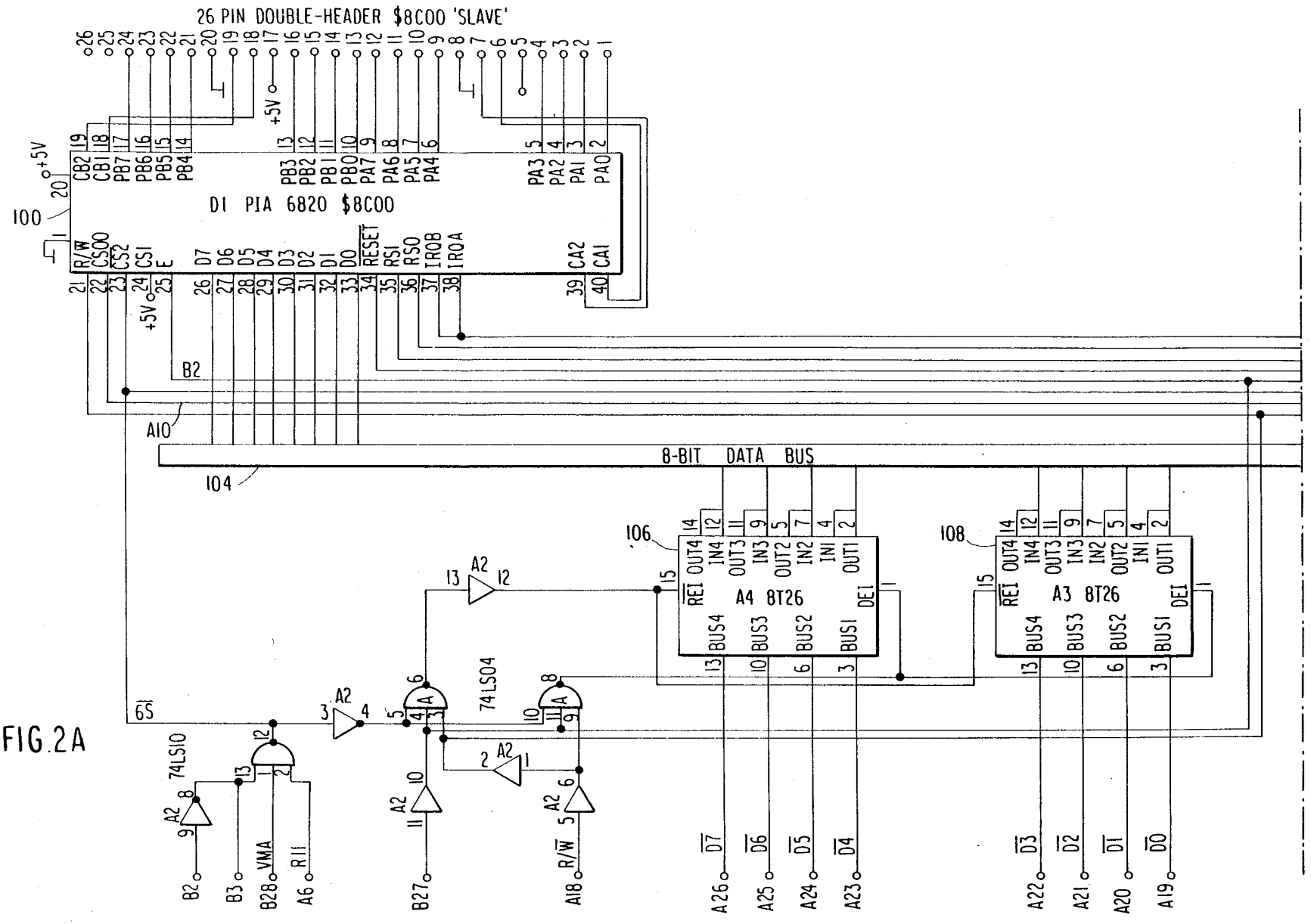
FIGS. 2A and 2B are a more detailed schematic diagram of the internal interface module (IIM) of FIG. 1.
Figures 2, 2A, 2B:
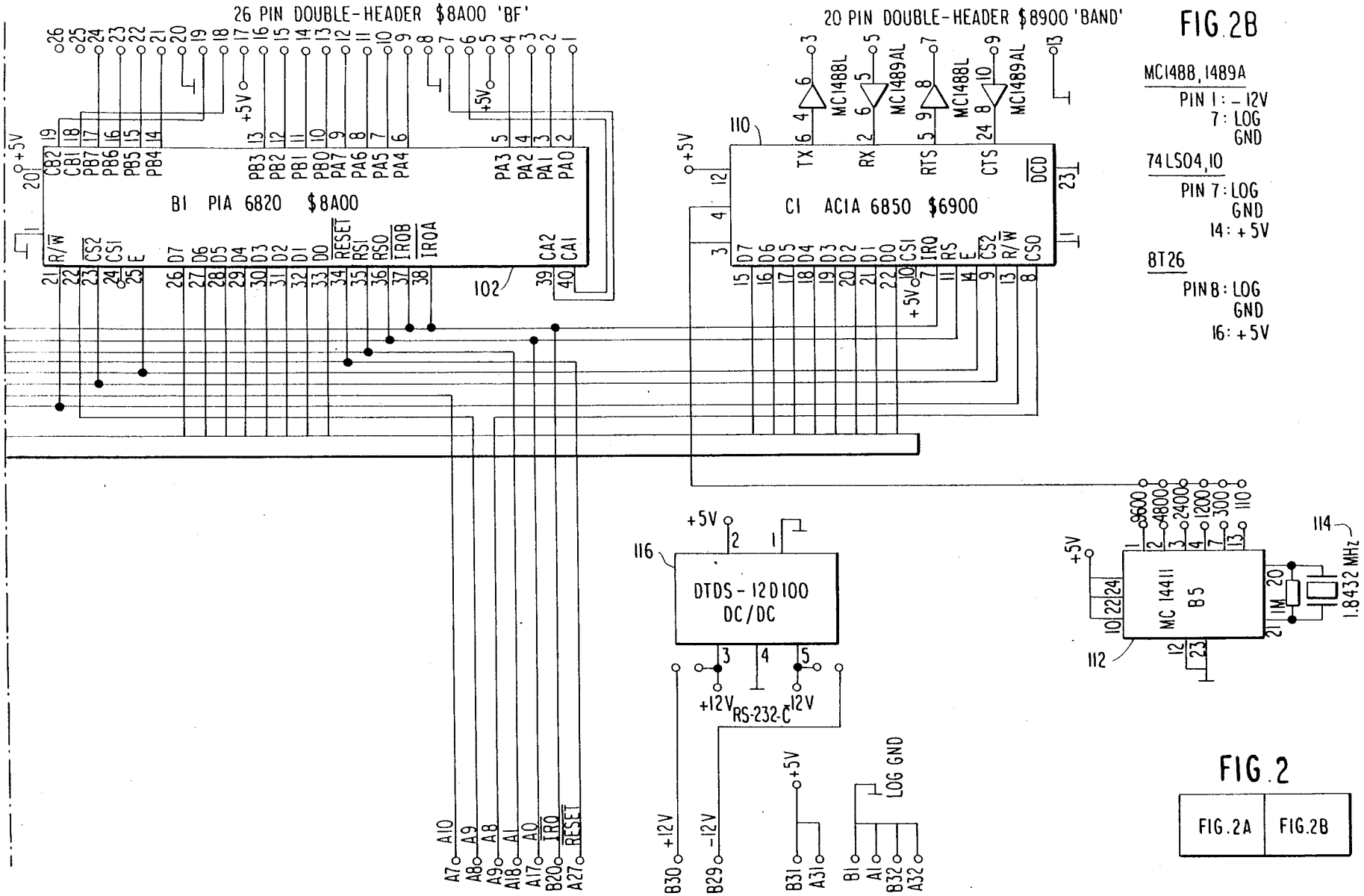

More particularly, referring to FIG. 2, the twin 6820 Peripheral Interface Adaptor (PIA) units 100, 102 each have their data outputs coupled to 8-bits bus 104 for bidirectional data communications over the common bus 8 via numeral 8T26 transceivers 106, 108. A 6850 Asynchronous Communications Interface Adaptor (ACIA) 110 is provided for serial data communications, e.g. with the data carrier 6 in FIG. 1. Clock signals are provided from a bit rate generator 112 which frequency divides the output of a crystal oscillator 114 in a known manner. Power is supplied from DC/DC converter 116, available from Burr-Brown.

Figure 3A:
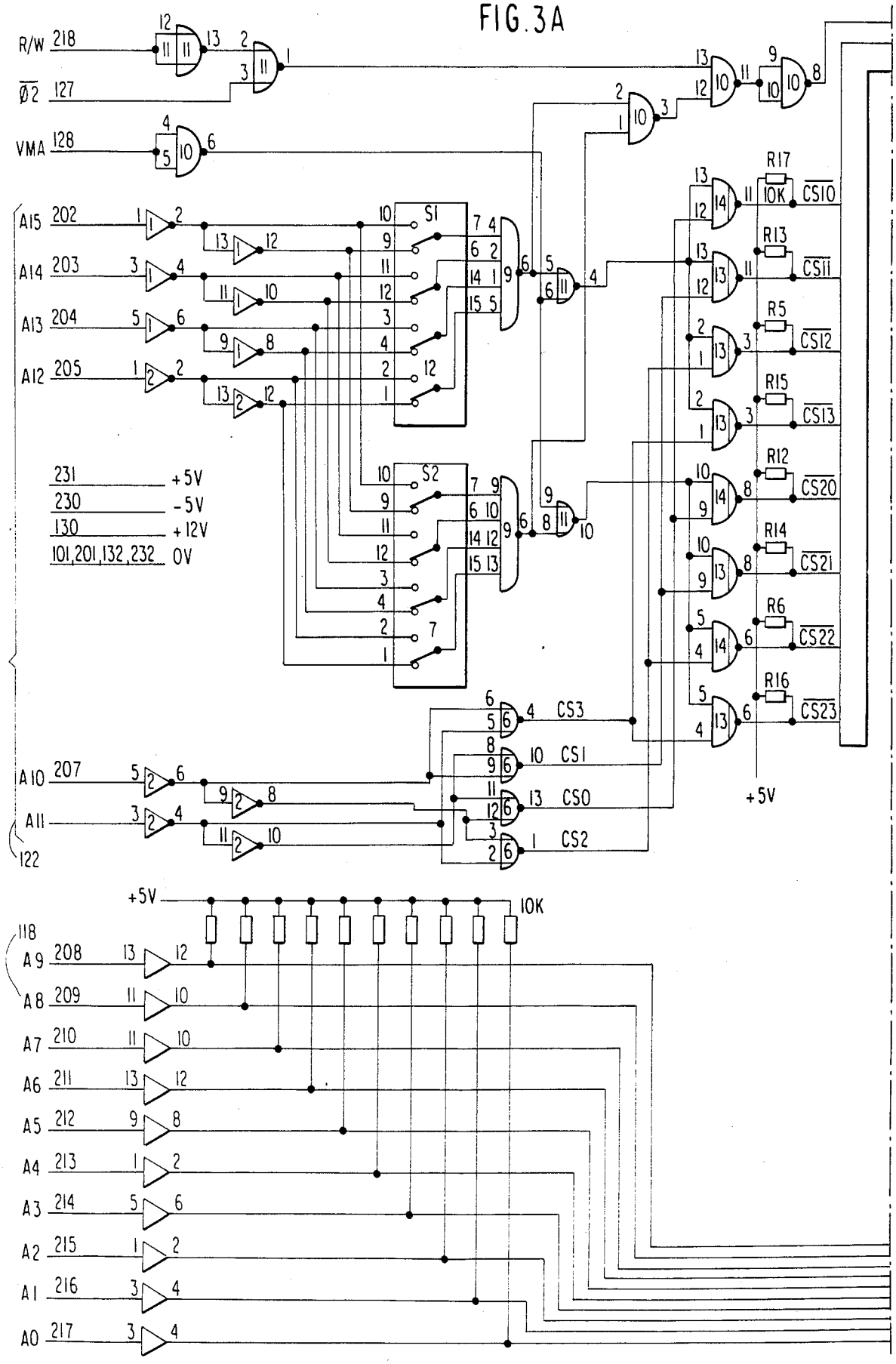
FIGS. 3A and 3B are a more detailed schematic diagram of the programmable ready only memory (PROM) of FIG. 1.
Figures 3, 3B:
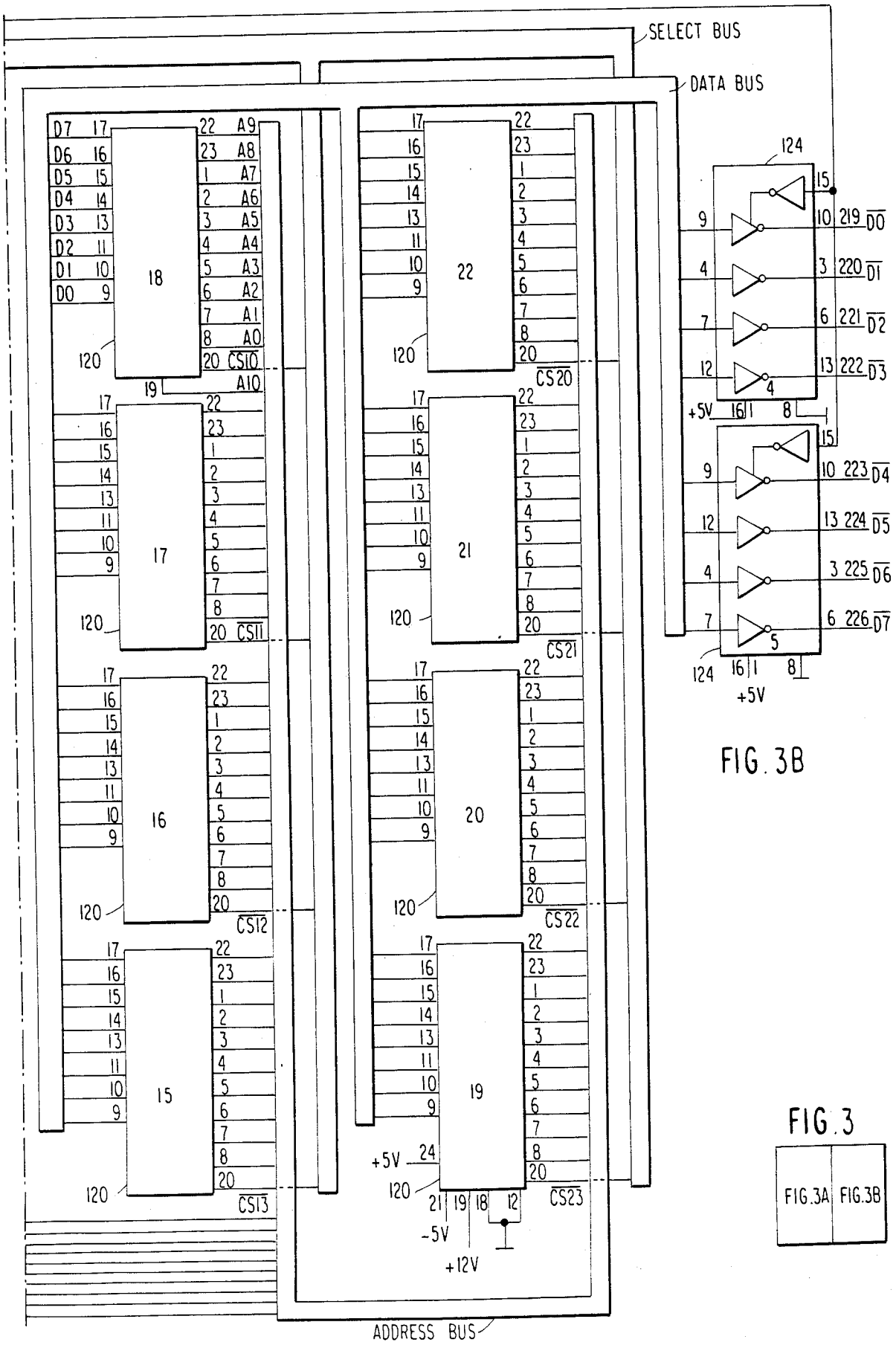
Figure 4A:
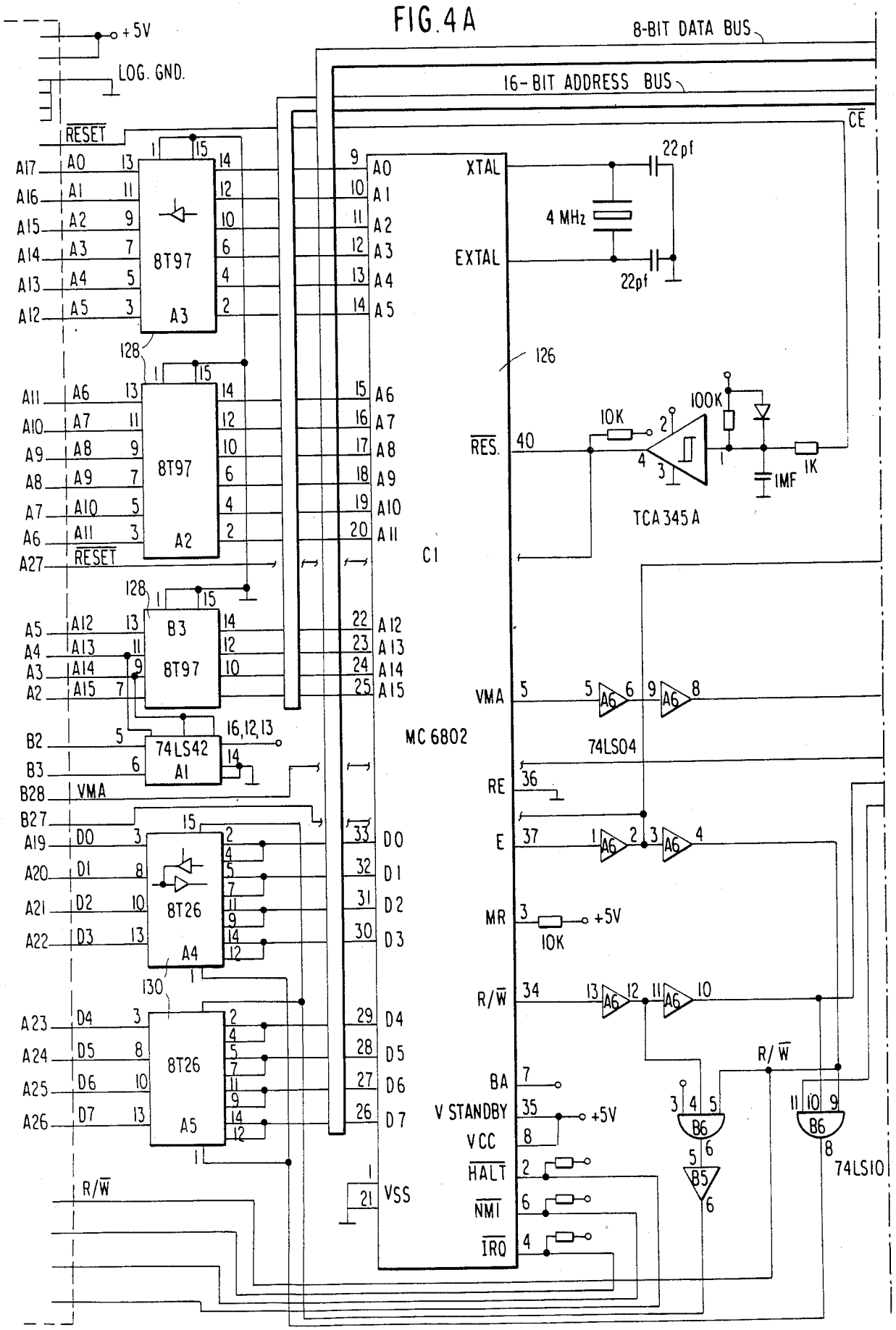
FIGS. 4A and 4B are a more detailed schematic diagram of the microprocessor module (MPM) of FIG. 1.
Figures 4, 4A, 4B:
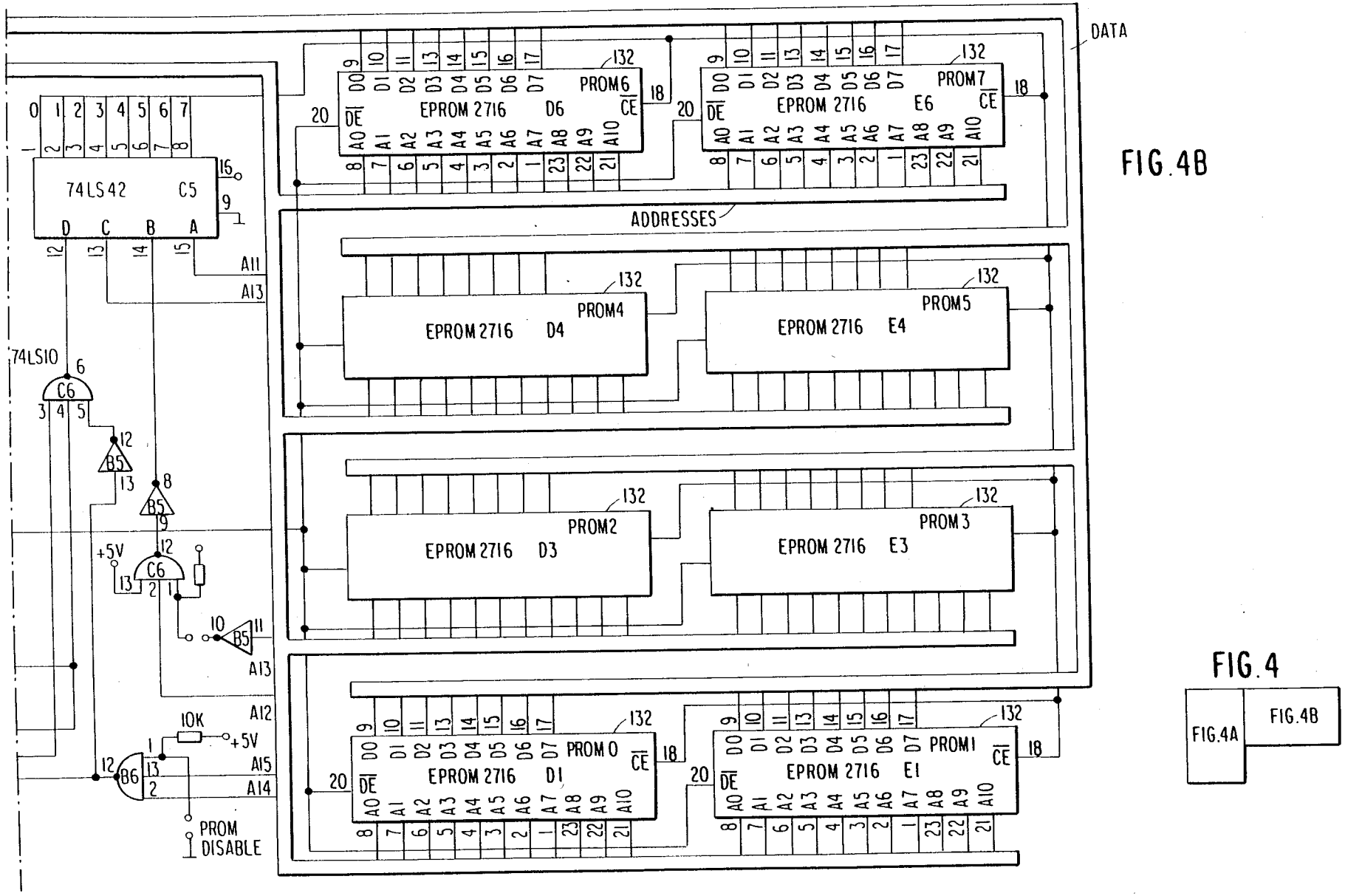

In FIG. 3, the PROM module receives its address via a first set 118 of address lines specifying the location in any given memory module 120 to be addressed, and a second set of address lines 122 specifying which one of the 8 modules 120 is to be addressed. The data output is provided via output buffers 124 to the data bus portion of the common bus 8 in FIG. 1. in FIG. 4, a 6802 microprocessor chip 126 communicates its 16-bit address information to the address portion of the common bus 8 via buffers 128, and is arranged for bidirectional data communication via output buffers 130. The microprocessors module is provided with 2716 Erasable Programmable Read Only Memory (EPROM) elements 132 for storage.

Figure 5A:
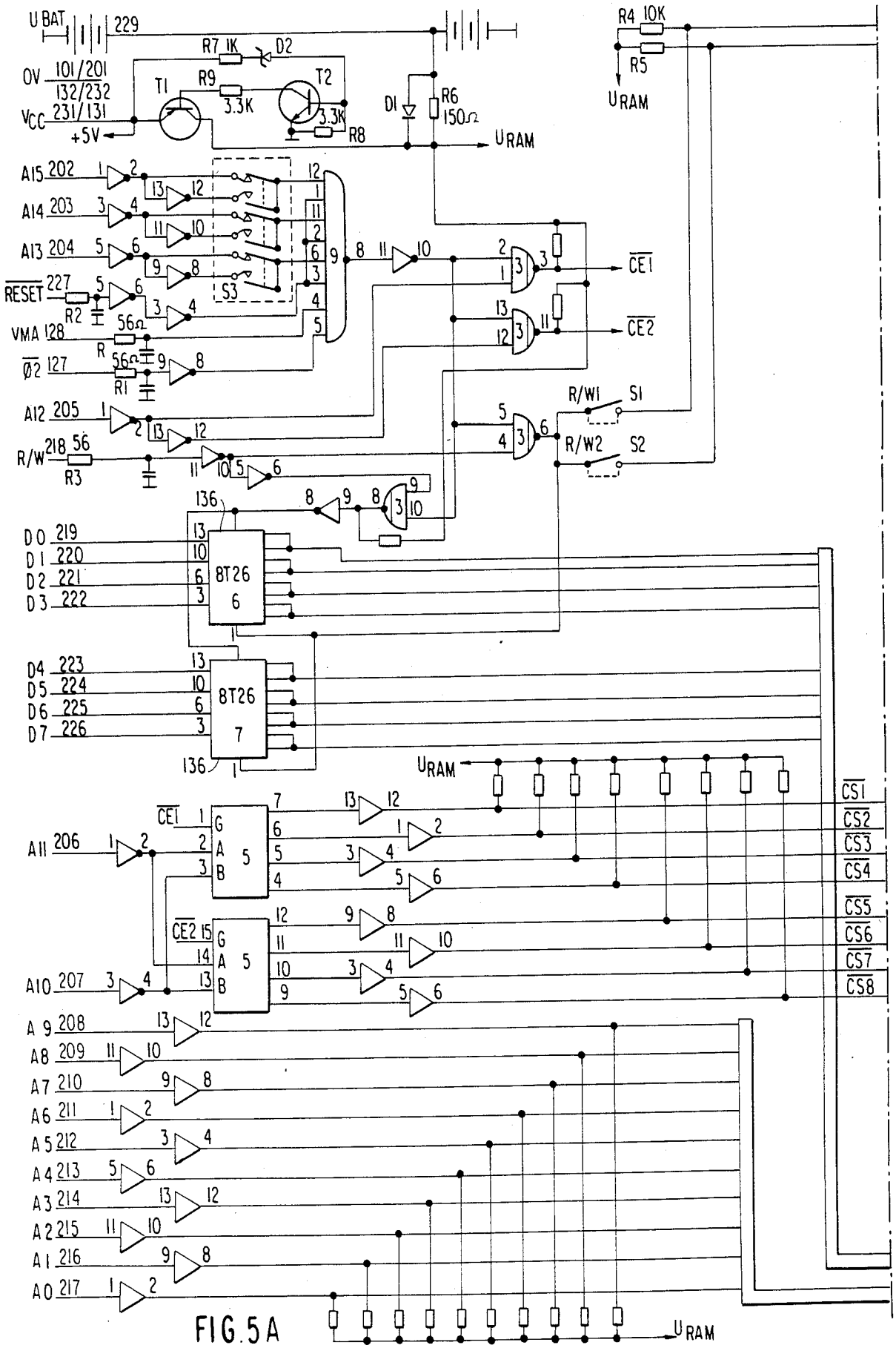
FIGS. 5A–5C are a more detailed schematic diagram of the random access memory (RAM) module of FIG. 1.
Figure 5B:
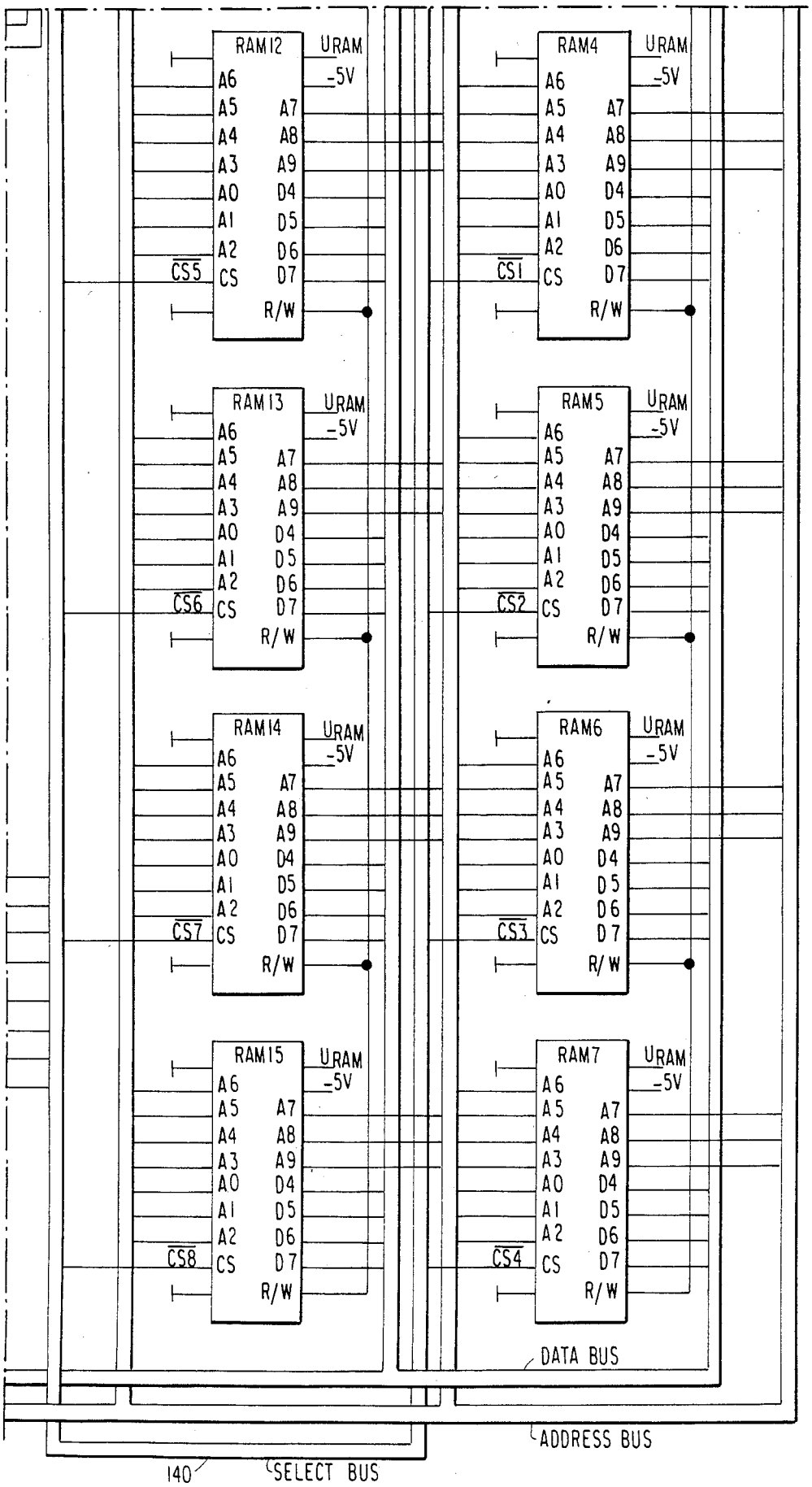
Figures 5, 5C:
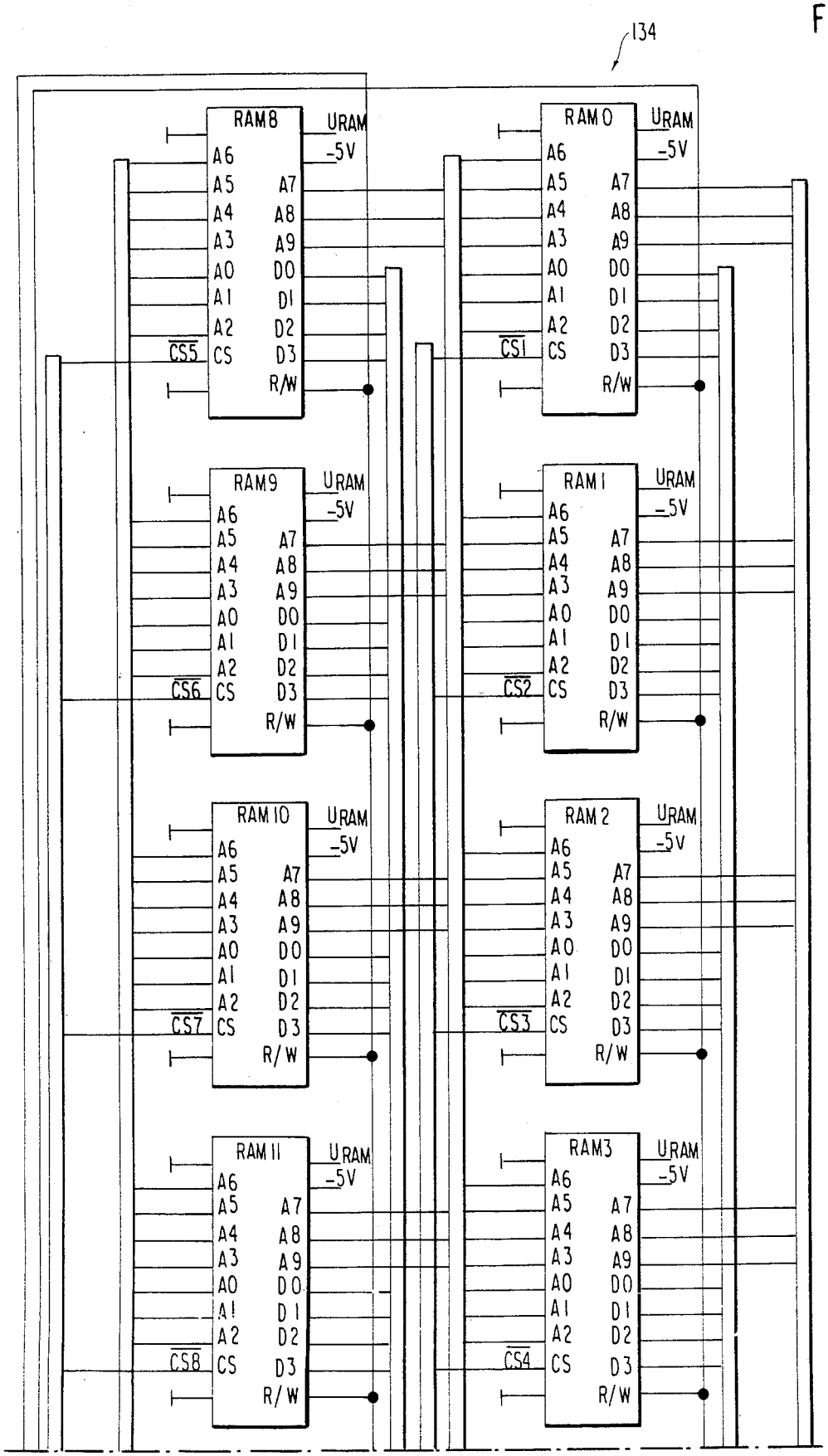

In FIG. 5, the Random Access Memory (RAM) module includes 16 ram chips 134 receiving 10 bits of address via lines A0–A9 from the common bus 8 in FIG. 1. Bidirectional data communication with the common bus 8 is accomplished via buffers 136. The remaining signals from the bus 8 are used to control the memory, for example, to control the reading and writing operations or to select via bus 140 which of the particular ram chips 134 is to be accessed.

For the operating function and construction respectively of the electronic control system according to claim 10, a data carrier device 6, e.g. a magnetic tape device, together with an associated data carrier 7, e.g. a magnetic tape cassette, is additionally connected to block 2.

We claim:

1. In an electronic control system for a flatbed knitting machine with electronic control, and control system being of the type having memory means for storing a first division of data containing motif pattern draft data, a second division of data containing needle set-up data, a third division of data containing knitting plan data, a fourth division of data containing function number schedule data and a fifth division of data containing plan run data, said knitting machine further comprising data entry means for entering data into said memory means, said knitting machine being of the type wherein a pattern is knitted in accordance with selected data retrieved from said memory means according to a knitting program, said knitted pattern employing at least one of a predetermined number of special knitting techniques corresponding to data sub-groups from said second division, the improvement comprising:

said memory means comprising a programmable fixed word memory, e.g. a programmable read only memory (PROM), for storing said data sub-groups from said second division together with associated special function numbers for call-up, whereby said at least one special knitting technique can be employed by merely designating its corresponding a special function number;

said memory means further comprising a freely accessible memory, e.g. a random access memory (RAM), for storing said second and fifth divisions of data as received from said data entry means, said freely accessible memory also storing an altered version of at least a portion of said second and fifth divisions of data, whereby a pattern portion corresponding to an altered version of at least a portion of said second and fifth data divisions can be knitted by merely retrieving said altered data version from said freely accessible memory; and said electronic control system further including a plurality of switches for selectively inhibiting portions of the pattern to be knitted by said program.

2. The improvement according to claim 1, wherein said data sub-groups from said second division and their associated special function numbers correspond to frequently used knitting techniques.

3. The improvement according to claim 1, wherein said data sub-groups from said second division and their associated special functions numbers correspond to the running of standard knitting such as separating courses with 2:1 welt and transfer courses.

4. The improvement according to claim 1, said data entry means comprising individual function keys for entering said data sub-groups from said second division, together with their associated function numbers.

5. The improvement according to claim 1, wherein, upon the storage of said second division of data for needle set-up, said freely accessible memory also stores data corresponding to needle set-ups in the reverse sequence.

6. The improvement according to claim 1, wherein, upon the storage of said fifth division of data for plan run, said freely accessible memory also stores data corresponding to the plan run steps in reverse.

7. The improvement according to claim 5, wherein, upon the entry of said second division of data for needle set-up, said freely accessible memory stores said second division of data with certain needles and/or courses of knitting omitted.

8. The improvement according to claim 6, wherein, upon the entry of said fifth division of data for plan run, said freely accessible memory stores said fifth division of data with certain needles and/or courses of knitting omitted.

9. The improvement according to claim 1, wherein said external selector switches are for selectively suppressing respective motif segments, whereby motifs can be designed without interfering with the knitting program by allocating motif segments to the respective external selector switches and by selective suppression of these motif segments by operating corresponding selector switches.

10. The improvement according to claim 1, further comprising means for extracting all data for the operation of the flatbed knitting machine from said memory means of the electronic control system and for transferring said extracted data to external data carrier means such as magnetic tape cassettes.

* * * * *